US005854438A

United States Patent [19]

Assayag et al.

[11] Patent Number: 5,854,438

[45] Date of Patent: Dec. 29, 1998

[54] PROCESS FOR THE SIMULATION OF SYMPATHETIC RESONANCES ON AN ELECTRONIC MUSICAL INSTRUMENT

[75] Inventors: Gérard Assayag, Gervais; Georges Bloch, Strasbourg, both of France

[73] Assignee: France Telecom, France

[21] Appl. No.: 827,713

[22] Filed: Apr. 8, 1997

[51] Int. Cl.[6] ..... G10H 1/057; G10H 1/46; G10H 7/00

[52] U.S. Cl. ..... 84/625; 84/627; 84/633

[58] Field of Search ..... 84/622–633, 659–665, 84/692–711

[56] References Cited

U.S. PATENT DOCUMENTS

| | | | |
|---|---|---|---|
| 3,790,963 | 2/1974 | Adachi . | |
| 4,909,121 | 3/1990 | Usa et al. | 84/627 X |
| 5,198,604 | 3/1993 | Higashi et al. | 84/626 |
| 5,455,380 | 10/1995 | Matsuda et al. | 84/662 |
| 5,648,629 | 7/1997 | Kozuki | 84/660 |

FOREIGN PATENT DOCUMENTS

| | | |
|---|---|---|
| A-0167847 | 1/1986 | European Pat. Off. . |
| A-0310133 | 4/1989 | European Pat. Off. . |

*Primary Examiner*—Stanley Witkowski
*Attorney, Agent, or Firm*—Burns, Doane, Swecker & Mathis LLP

[57] ABSTRACT

To simulate sympathetic resonances for an electronic musical instrument, during the playing of free notes an excited notes, updating takes place of a first list (26) of free notes and their harmonics and of a second list (28) of excited notes ans their harmonics. At each activation of a free note, for each harmonic of said free note, is sought at least one identical harmonic of a note of the second list (28) and the playing of a sympathetic note is controlled with the pitch of each identical harmonic, and at each activation of an excited note, for each harmonic of said excited note, is sought at least one identical harmonic of a free note of the first lest (26) and the playing of a sympathetic note is controlled at the pitch of each identical harmonic.

22 Claims, 2 Drawing Sheets

PROCESS FOR THE SIMULATION OF SYMPATHETIC RESONANCES ON AN ELECTRONIC MUSICAL INSTRUMENT

TECHNICAL FIELD

The present invention relates to a process for the simulation of sympathetic resonances on an electronic musical instrument.

The invention has applications for any electronic musical instrument able to receive note activation or release controls, either directly, or by means of an interface such as e.g. a MIDI standard instrument interface.

It more particularly applies to any synthetic pianoforte such as a digital piano, a sampler or a musical synthesizer.

PRIOR ART

Sympathetic resonance phenomena occur more particularly on stringed instruments. On such instruments, the strings can occupy several states. They can be precisely excited, i.e. incited by the musician, muffled, i.e. held to prevent their vibration, or free, i.e. free to resonate.

When a string is free, it is liable to vibrate according to one of its vibration modes corresponding to a harmonic. In the sense of the present invention, harmonic of a string and by extension a note of a random instrument, is understood to mean both the fundamental harmonic corresponding to the vibration mode of the lowest frequency of the string and higher order harmonics corresponding to vibration modes at a higher frequency.

When a free string of a musical instrument is in the vicinity of a vibrating string, i.e. excited by the musician, and the two strings have common vibration modes, i.e. harmonics with an Identical pitch, the free string tends to vibrate by sympathy with the excited string.

This phenomenon known as "sympathetic resonance" is particularly important in instruments such as the sitar, theorbo and viola d'amore. These instruments have strings, whose pitch can be changed when playing, and open strings resonating by sympathy therewith.

Sympathetic resonance also takes place in a piano in which the free strings or wires corresponding e.g. to pressed keys, vibrate by sympathy with the harmony of the other strings or wires.

It should be noted in this connection that the sympathy phenomenon in a stringed instrument does not necessarily require the excitation to result from a string by the actuation of a key of the keyboard. For example, when pressing on the pedal of a piano and shouting "Beethoven" into the open piano, as in a composition by Pauline Oliveras, it is the voice which provokes the sympathetic resonance of the strings.

Electronic instruments do not have strings able to resonate and consequently do not produce the note corresponding to a pressed key or electronic control having a string for activating said note.

When the electronic instrument assumes the tone quality of a stringed instrument, the sound produced corresponds to the vibration of the strings in accordance with their fundamental harmonics. Each note played by the musician is independent of the other notes simultaneously played on the electronic instrument. Thus, known electronic instruments cannot restore the sound colouring of the sympathetic resonance of acoustic instruments, whose tone quality they assume.

Moreover, in certain works, particularly for the piano, keys are pressed silently in order to release the strings and deliberately bring about a sympathetic resonance with these strings. These works, including the Carnival of Venice by Schumann, the Opus 11, No. 3 by Schoenberg and the Ligeti Studies, can consequently not be correctly interpreted on known electronic musical instruments.

Electronic instruments also do not make it possible to obtain acoustic effects such as those resulting from an excitation by the voice of an instrument such as a piano, as indicated hereinbefore.

The object of the present invention is to propose an improved simulation process making it possible to realistically reproduce the sympathetic resonances of stringed instruments and in particular the piano, by an electronic instrument.

Another object of the invention is to provide a solution to the autoresonance problems liable to result from sympathy.

Another object of the invention is to permit the creation of sympathetic resonance effects on electronic musical instruments using tone qualities other than those of stringed acoustical instruments.

A further object of the invention is to propose a process for the simulation of sympathetic resonances permitting sound effects like those obtained by exciting the strings of an acoustic piano by the voice or another instrument.

Yet another object of the invention is its use as a control for a synthesis process taking account of the context of the instrument (i.e. notes which are resonating, excited or free).

DESCRIPTION OF THE INVENTION

In order to achieve the objects referred to hereinbefore, the invention more specifically relates to a process for the simulation of sympathetic resonances for at least one electronic musical instrument able to generate sounds for a set of notes and able to receive activation or release controls of excited and/or free notes, wherein:

- updating takes place of at least one first list of free notes and with each free note are associated harmonics of said free note, the first list being more particularly updated during each free note activation and release,
- updating of a second list of excited notes and with each excited note are associated harmonics of said excited note, the second list being more particularly updated during each excited note activation and release,
- for each free note activation, for each harmonic of said free note is sought at least one identical harmonic of a note of the second list, differing from said free note, and the playing of a sympathetic note is controlled at the pitch of each identical harmonic and
- for each excited note activation, for each harmonic of said excited note is sought at least one identical harmonic of a free note of the first list, differing from said excited note and the playing of a base note at the pitch of a fundamental harmonic of said excited note is controlled and also a sympathetic note at the pitch of each identical harmonic.

The terms "excited note" and "free note" are to be understood in connection with playing on a keyboard with keys comparable to those of a piano, or any other interface permitting similar controls.

More specifically, it is considered that a note is excited when the corresponding key of the keyboard is pressed at a speed higher than a predetermined speed. By analogy, this corresponds to a sufficiently powerful striking of a key of an acoustic piano to bring about a blow or percussion of the corresponding hammer on the associated string or strings.

An excited note can also be compared with the touching of a string of a guitar with a plectrum or the rubbing of a bow on the string of a cello.

It is considered that a played note is free when the corresponding key of the keyboard is pressed with a speed lower than the predetermined speed.

For comparison with an acoustic piano, this corresponds to a gentle pressing of a key, bringing about the withdrawal of the muffling felt, without any active blow of the hammer.

In the performance of the process according to the invention the activation or release controls of the free or excited notes can e.g. result from a MIDI-type keyboard sensitive to the attack velocity of the keys or an appropriate MIDI sequencer.

When simulating sympathetic resonances of a piano, it is considered that any excited note is also a free note. Thus, in an acoustic piano, the striking of a key not only brings about a percussion of the hammer, but also the withdrawal of the muffling felt from the corresponding string or strings.

Thus, for the simulation of sympathetic resonances of a piano, during a control of an excited note, there is an updating of both the first and second lists by adding said note thereto. The first and second lists are also updated during release controls for the free or excited notes.

During the activation of an excited note, no sympathetic resonance should be produced between the harmonics of said excited note and the harmonics of the same note, considered as a free note. For this reason, identical harmonics of free notes different from the excited note are sought in the first list. In the same way, identical harmonics of excited notes different from the free note are sought in the second list. This avoids the so-called auto-resonance phenomenon.

In order to respect this constraint, one possibility consists of systematically verifying for each excited note and each free note considered and having an identical harmonic, that the two notes are indeed different.

Another possibility consists, during a control of an excited and also free note of firstly updating the second list with the excited note and then, after seeking notes with an identical harmonic in the first list and the playing of possible corresponding sympathetic notes, updating the first list with the free note. This economizes an autoresonance test, because the excited note is not immediately considered as free and consequently does not appear in the first list during the seeking of common harmonics.

Thus, on seeking harmonics identical to those of a note of the first list, the free note corresponding to the excited note still does not appear there. However, on adding said note to the first list and seeking in the second list identical harmonic pitches, it is necessary to verify that they do not come from the same note.

According to a particular aspect of the invention, it is possible to control the playing of each base note and each sympathetic note with a volume evolving in time from an instant defined by the activation of said note, in accordance with a user-modifiable, predetermined envelope.

In the case of an electronic instrument assuming the tone quality of the piano, the envelope has an exponential fall after reaching the maximum volume. The fall and more generally the shape of the envelope can also depend on the pitch of the note played.

According to an example for checking the volume of the notes, when a note is excited, the volume of the corresponding base note $V_b$ (t) can be of the form $V_b(t)=V_o*e^{-t}$, in which t is the time which has elapsed since the excitation instant and $V_0$ is the power or velocity of the note played. If the apparatus permits a variable volume, it is possible either to increase the volume of the sympathetic note in a mariner corresponding to the contribution of each free note, or, which is more realistic but more expensive as regards polyphony, activate a new sympathetic note with the same pitch for each free note.

In the case where the electronic instrument assumes the tone quality of an instrument for which the sound is not activated, but continuous, such as stringed instruments played with a bow, the volume $V_b(t)$ is preferably adjusted, not as a function of an envelope, but as a function of controls from the instrumental interface.

These controls then take account of variations of the excitation of the excited note, said variations resulting from nuances of playing, "bow blows", etc.

The playing of a sympathetic note can be activated with a volume:

$$Vs(t)=V_b(t)\times P_{he}\times P_{he}$$

where $P_{he}$ and $P_{he}$ are respectively the corresponding harmonic potentials of the excited note and the free note. The potentials of a harmonic are between the ratio of the volume of said harmonic to the fundamental harmonic.

The potentials of the harmonics of each note are predetermined values, which can be stored in a memory of the instrument or the simulation system.

When a sympathetic note is activated several times from different free notes for which its pitch corresponds to harmonics of different orders, the volume of said sympathetic note can be the sum of several contributions corresponding to different free notes.

In the first case, in exemplified manner, the volume is then $$V_s(t) = V_b(t)xP_{he}x\sum_{i=1}^{n} P_{hli},$$

in which $P_{hei}$ is the potential of the harmonic corresponding to the ith free note taken among n free notes in all and to which corresponds the sympathetic note.

According to another aspect of the invention, it is also possible to suspend the playing of a base note when the volume $V_b(t)$ drops below a predetermined value. In the same way, it is possible to suspend the playing of a sympathetic note when its volume is below a predetermined value. When the number of free and excited notes becomes high, it is possible to limit the number of sympathetic notes by increasing said predetermined value.

When a sympathetic note only corresponds to the harmonic of a single free note, the playing of the sympathetic note is stopped as soon as the release control for the corresponding free note is given. This is always the case when the variable volume is not used.

In the other case, as indicated hereinbefore, each sympathetic note played can correspond to several different free notes. The sympathetic note pitch then corresponds to different order harmonics of different free notes. Thus, it is possible to only stop the playing of the sympathetic note when all the free notes are no longer played, i.e. following a release control of all the free notes. When only a few free notes are "released", the playing of the sympathetic note can take place with a volume reduced as a consequence thereof.

More specifically, the volume can be decreased as a function of the potential of the harmonics of the released free notes corresponding to the pitch of the sympathetic note played. This corresponds to eliminating in the expression of $V_S(t)$, the terms $P_{hei}$ corresponding to the harmonics of the released free notes.

According to a particular application of the process according to the invention, it is possible to direct the controls of the playing of the base notes and the free notes towards a same polyphony channel or line of a single electronic musical instrument, i.e. a single electronic sound emulator, sampler or synthesizer. In this case, the sympathetic notes resonate assuming the same tone quality as the base notes.

According to a variant, it is also possible to direct the controls of the playing of base notes and respectively sympathetic notes to different instruments, or to different polyphony channels of one instrument.

In this case, the tone quality and/or optionally the envelope of the sympathetic notes can be different from those of the base notes. This is the case in acoustic reality (the sympathetic resonance sound of a piano has a different attack of the sound from an excited note). However, this characteristic makes it possible to create original sound effects. It is e.g. possible to create a sympathetic resonance with the tone quality of a clarinet for notes played with a piano tone quality.

It is also possible to create sympathetic resonances for instrument tone qualities, which in their acoustic form do not naturally have the sympathetic resonance phenomenon, such as most wind instruments.

In a variant of the process according to the invention more particularly adapted to the electronic reproduction of the sonorities of an acoustic piano, apart from the simulation of the sympathetic resonance from the free notes played, designated by first resonance in the remainder of the description, simulation takes place of a second sympathetic resonance corresponding to a so-called pedal activation.

The second sympathetic resonance is simulated from the activation as the free note of all the notes for which the instrument is able to generate sounds.

For example, to simulate the second resonance, for each harmonic of each excited note identical harmonics are sought among the harmonics of all the notes for which the instrument is able to generate sounds and different from the excited note, and the playing of a sympathetic note with the pitch of each of said identical harmonics is controlled.

The second pedal sympathetic resonance is not substituted for the first resonance, but is instead at least partly added thereto.

In the remainder of the text, in order to distinguish sympathetic notes resulting from played free notes, e.g. on a keyboard, and sympathetic notes resulting from pedal activation, the latter are respectively designated sympathetic first resonance notes and sympathetic second resonance notes.

The volume of first and second resonance sympathetic notes can be chosen proportional to the pitch of the notes and to the harmonic potentials in the manner described hereinbefore. However, the respective volume of first and second resonance sympathetic notes can also be weighted as a function of a degree or intensity of activation of the pedal control. For example, the volume of sympathetic notes of second resonance can be increased to the detriment of sympathetic notes of first resonance, for an increasing depressing of a pedal or a control of an instrumental interface comparable to the pedal of a piano or vice versa. This permits half-pedal effects which cannot be obtained on existing synthetic instruments.

The invention also relates to an apparatus for sympathetic resonance simulation for an electronic musical instrument comprising:

at least one input able to receive activation and release control signals for excited played and/or free notes, updating means in a memory of a first and a second list of free and excited notes, and means for associating with said notes the harmonics corresponding thereto, the updating means being able to add or subtract from the first list of free notes during a free note activation, respectively release control, and able to add or subtract from the second list of excited notes, during an excited note activation, respectively release control, means for seeking during each free note activation and for each harmonic of the free note, at least one identical harmonic of a different note in the second list and for seeking, during each excited note activation and for each harmonic of the excited note, at least one identical harmonic of a different note of the first list, a control signal generator for playing a base note corresponding to the pitch of a fundamental harmonic of each excited note and a sympathetic note corresponding to the pitch of each identical harmonic.

According to a particular embodiment of the means for associating harmonics with the free and excited notes, they can have in a memory a correspondence table between each note of the electronic musical instrument and a set of harmonics associated with each note.

The table can also incorporate harmonics of each note, as well as potentials of each harmonic. The potential of a harmonic, as defined hereinbefore, is understood as a factor characterizing the volume at which must be played a sympathetic note corresponding to the harmonic pitch. This potential can depend not only on the pitch of the note, but also the note harmonic order.

According to another embodiment of the means for associating harmonics with free and excited notes, they can incorporate a calculation software for harmonics and optionally their potentials.

The means for updating the first and second lists can also incorporate a software.

The means for seeking identical harmonics in the lists can be pointer-equipped data processing means also operating with a search software using conventional optimizations for such data.

According to an aspect of the invention, the sympathetic resonance simulation apparatus can incorporate means for updating a second first list containing a set of all the possible free notes of the instrument.

The means for seeking common harmonics are then also able to seek during each activation of an excited note and for each harmonic of the excited note, at least one identical harmonic of a note different from the excited note in the second first list for controlling corresponding sympathetic notes.

Other features and advantages of the invention can be gathered from the following description of non-limitative embodiments with reference to the attached drawings.

DETAILED DESCRIPTION OF EMBODIMENTS OF THE INVENTION

Figure 1:
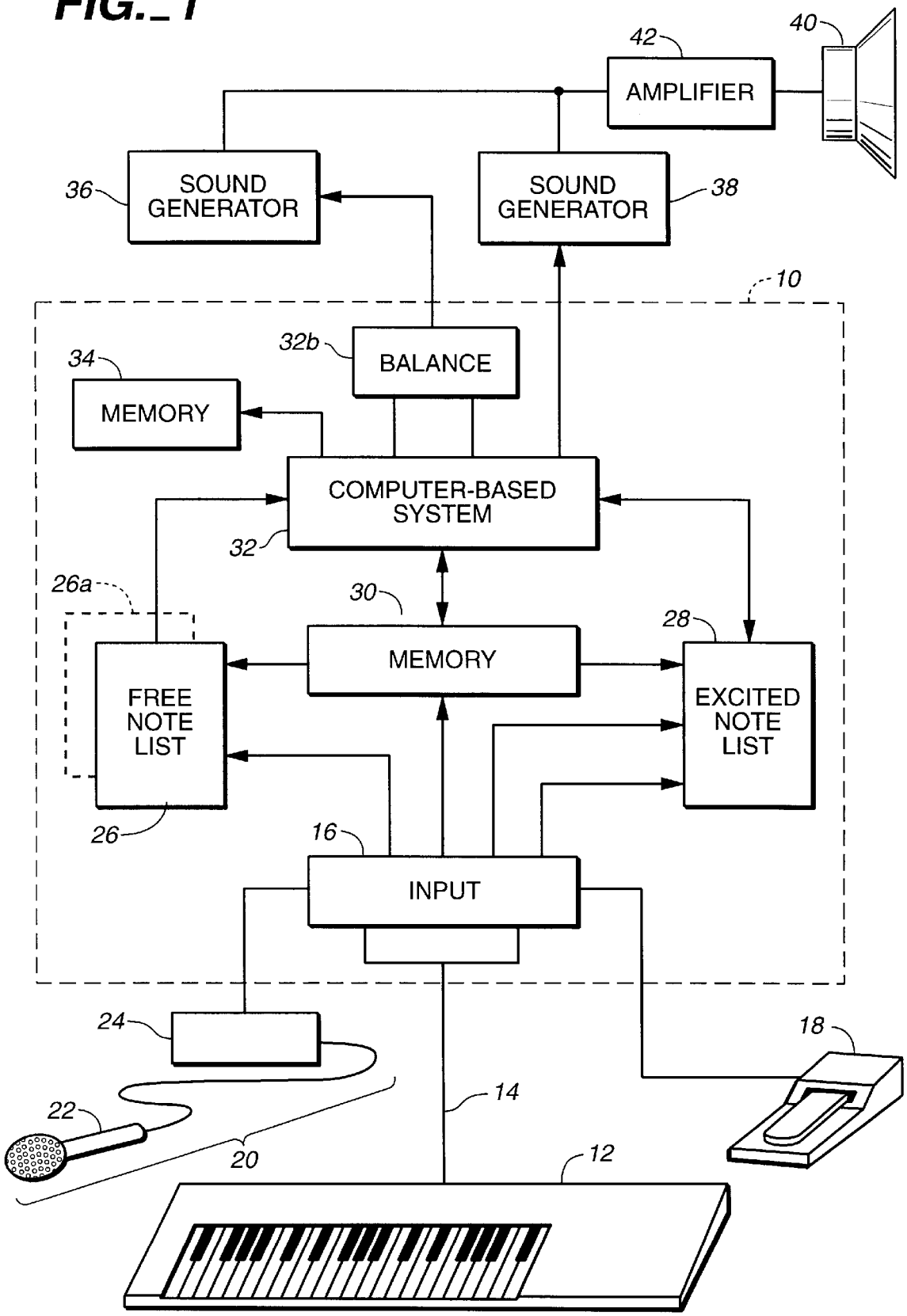
FIG. 1 is a simplified diagrammatic view of an apparatus for performing the invention.

FIG. 1 diagrammatically shows a sympathetic resonance simulation apparatus 10 according to the invention.

The simulation apparatus 10 comprises an input 16 receiving controls supplied either by the digital keyboard 12, or by a pedal interface 18, or by a subsequently described voice or instrument control system 20.

The digital keyboard 12 is connected to the apparatus 10 by means of a cable 14 able to carry MIDI standard signals corresponding more particularly to controls for the activation and release of notes played by an instrumentalist on the keyboard. For each note played, these signals also include information relating to the corresponding key attack velocity of the keyboard 12.

The input 16 makes it possible to classify the activation controls from the keyboard 12 as a function of speed information and thus distinguish the free notes from the excited notes.

A note is considered as free as soon as the corresponding key of the keyboard is kept depressed and no matter what the attack speed exerted on the key by the instrumentalist.

A note is considered as excited when the key is depressed with a speed exceeding a predetermined value, which can optionally be a parameter of the apparatus 10 which can be adjasted by the instrumentalist.

In the example described here, the activation controls of excited notes supplied by the keyboard 12 are necessarily also free note activation controls.

The operation of the pedal 18 makes it possible to supply the input 16 of the apparatus 10 with a control corresponding to the activation of all the notes of the electronic instrument considered to be free notes.

The processing of this control by the simulation apparatus is described subsequently.

The voice or instrument control system 20 incorporates a microphone 22 and a converter 24 able to convert the microphone signal into MIDI-type controls. These controls are recognized by the input 16 as excited note and non-free controls. This arrangement makes it possible to simulate sound effects similar to those obtained by exciting the free strings of an acoustic piano by the voice, as described in the introduction to the present specification. The apparatus then has a table or formula making it possible to determine the corresponding harmonic potential for each pitch, at the voice or instrument intercepted by the microphone 22. Moreover, sympathetic resonance excitations by the voice can also be implemented for tone qualities other than those of the piano if this is permitted by the electronic musical instrument.

The combined use of the keyboard 12 and the system 20 makes it possible to define e.g. the free notes exclusive to the keyboard and the notes excited by the system 20.

The free notes and excited notes are used for updating a free note list 26 and an excited note list 28. The free and excited notes are added to the lists 26 and 28 during their activation and are withdrawn or subtracted during their release on the keyboard.

Harmonics of each note, as well as the harmonic potential of these harmonics are associated with each free or excited note.

Figure 2:
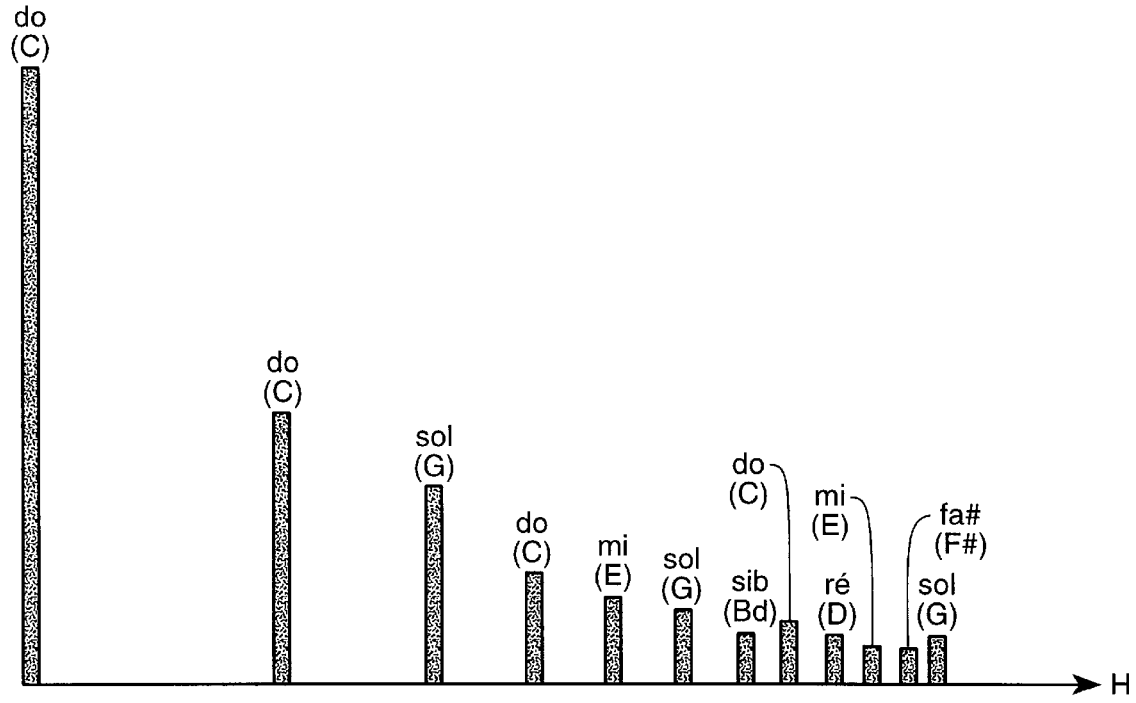
FIG. 2 is a graph showing the harmonics of a note: C and their respective potentials.

FIG. 2 illustrates a set of harmonics and their potentials associated with a note which, in this case, is C.

By analogy with a stringed acoustic instrument, the harmonics correspond to the vibration modes of a string corresponding to the free or excited note.

On a horizontal axis appear the H harmonics of C as a function of their pitch. The pitches pass from bass to high-pitched sounds reading the graph from left to right.

Rods associated with each harmonic have a height proportional to the potential of each harmonic. By analogy with an acoustic instrument, this corresponds to the amplitude of the vibration mode of a string according to each of its harmonics.

The free or excited note is C, which corresponds to the fundamental harmonic with the highest potential.

The following harmonics are shown in FIG. 2:

C at the octave,
G at the octave,
C of the second octave,
E of the second octave,
G of the second octave,
Bb of the second octave,
C of the third octave,
D of the third octave,
E of the third octave,
F# of the third octave, and
G of the third octave.

Figure 3:
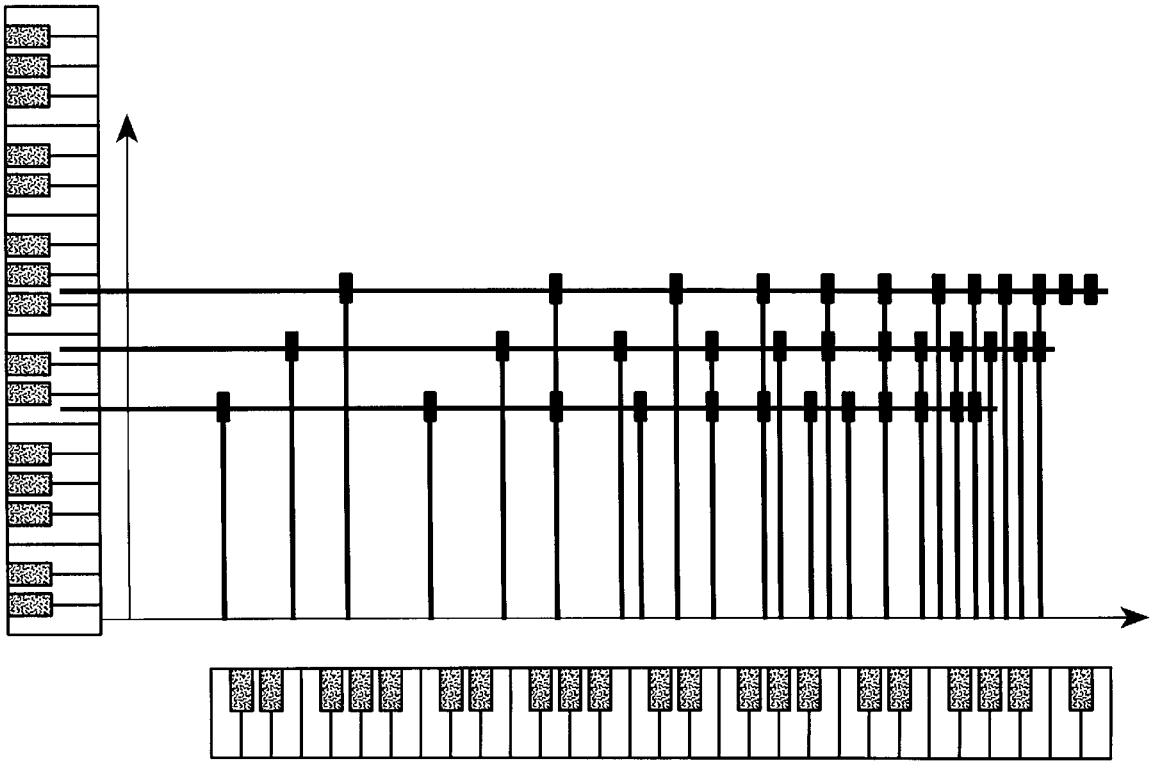
FIG. 3 is a graph indicating an example of correspondence between free notes played C, E and G and the associated harmonics.

FIG. 3 shows using the example of a set of harmonics associated with three free notes corresponding to a C chord activated on the keyboard 12 (FIG. 1).

In FIG. 3 the free notes are plotted on the ordinate as a function of their pitch. The harmonics of these free notes appear on the abscissa. Points represent the correspondence between the free notes and their harmonics.

In order to simplify the reading of the pitches of the notes and their harmonics, the latter are diagrammatically represented by the keys of a keyboard starting with C and whose succession is:

C, C#, D, D#, E, F, F#, G, G#, A, A#, B, C.

As can be gathered from FIG. 3, the free notes make it possible to define a bidimensional table having on the one hand the pitches of the free notes and optionally the instant of their activation and on the other the corresponding harmonic pitches.

The process of the invention makes it possible to take account of the set of harmonics of a note or only a limited number of harmonics having the highest harmonic potentials.

Reference 30 in FIG. 1 corresponds to a memory containing a set of harmonics and the corresponding harmonic potentials of all the notes which can be played on the electronic instrument, or a computer able to calculate the harmonics and their potentials from the pitch of the free or excited note.

For information, this calculation can be performed taking account of the sensitivity values of each harmonic frequency compared with the fundamental harmonic, said values being stored in a table of a memory and carrying out a weighting of the harmonic potential, on the basis of this sensitivity and the pitch of the free or excited note in question.

A computer-based system 32 able to operate according to a programmed algorithm makes it possible, on the basis of first and second lists, to determine sympathetic notes which must be played by the instrument to simulate sympathetic resonance. It performs two types of calculation, either in the case of a new free note, or in the case of a new excited note.

The first calculation performed by the system 32 makes it possible to seek during each activation of an excited note and for each harmonic of said note, one or more harmonics identical to the harmonics of all the free notes of the first list and differing from the excited note.

In the same way, during each activation of a free note and for each harmonic of the free note, the system 32 makes it possible to seek one or more identical harmonics of excited notes differing from the free note in the second list.

The harmonics and their potentials relative to the free and excited notes to which they correspond are stored with the free note in a memory 34. The system 32 transmits to one or more sound generators commands for the playing of a sympathetic note at the pitch of each harmonic determined in the aforementioned manner. The system 32 also transmits controls for the playing of base notes corresponding to the pitches of fundamental harmonics of the excited notes.

The base notes correspond to the notes which would be played in the absence of the sympathetic resonance simulation apparatus, i.e. if the keyboard 12 was directly connected to the sound generator.

In FIG. 1, the system 30 is connected by electrical connections to two sound generators 36 and 38 to which are respectively supplied the controls of sympathetic notes and base notes.

The system 32 also transmits to the generators 36 and 38 controls corresponding to the volume and optionally envelope of the notes 36 and 38. The volumes for playing sympathetic notes and base notes are determined by the system 32 in one of the ways described hereinbefore either with a variable volume for each harmonic pitch, or with an activation for any harmonic correspondence between a free note and an excited note. In all cases, the speed is dependent on the speed of the excited note, potentials of respective harmonics of the free and excited notes, and the time difference between the excitation instant and the time when the note is free (activation of the corresponding free and excited notes).

In order to illustrate the operation of the system 32, hereinafter is given in simplified manner an example of the stages for the simulation of sympathetic resonances corresponding to the pressing on the keyboard 12 of a G and a D, the G being played slightly before the D.

The G and D are played with a speed exceeding the predetermined speed and it is considered that they correspond both to a free note and an excited note.

The pitches of the notes and their starting volume are indicated by the figures corresponding to the MIDI standard and we have in order:

free G (no excitation),
updating the first list,
excited G,
updating the second list,
activation of the base note,
G: pitch 55, volume 121,
free D,
updating the first list,
activation of sympathetic notes:
- D: pitch 74, volume 17 (sympathetic resonance of the octave of D)
- D: pitch 86, volume 2 (sympathetic resonance of the second octave of D), excited D,
updating the second list,
activation of the base note
- D: pitch 62, volume 127,
- activation of the sympathetic notes by D excited with the free G,
- D: pitch 74, volume 18
  third harmonic of G,
- D: pitch 86, volume 2
  sixth harmonic of G.
- releasing D leads to the stop control
- of the base note of D (62),
- sympathetic notes due to the free D: D 74, D 86.

However, as G is still depressed and although D is released, the sympathetic notes due to the free G (D 74, D 86) remain. Thus, the pitches 74 and 86 are played with a reduced volume.

When G is finally released, this gives rise to a stop control of the base note of G (55),
of sympathetic notes due to the free G: D 74, D 86.

The envelopes for the base notes and the sympathetic notes can be identical or different.

The sound generators 36 and 38 can also have identical or different tone qualities. It is e.g. a question of two different voices of an electronic instrument of the polyphonic type or sound generators of different electronic instruments.

The generators 36 and 38 are connected to a loudspeaker-based sound restoration system 40 by amplifier means 42.

In order to more precisely simulate the resonances of an acoustic piano, the system 32 can also incorporate a program for performing a second sympathetic resonance simulation with all the harmonics of all the available free notes of the instrument, when the pedal 18 is operated. This can take place e.g. by establishing a second first list 26*a* with all the possible free notes.

The sympathetic notes then correspond to the identical harmonics to the excited notes with any random one of the harmonics of the free notes.

The system 32 then directs to the generator 36 controls both of the sympathetic notes of the first and second resonances, i.e. sympathetic resonance notes coming from the free notes of the keyboard 12 and sympathetic resonance notes from the pedal 18.

The volume of sympathetic notes of the first and second resonances, still defined in the manner described hereinbefore, is also weighted by the degree of depression of the pedal 18. For this purpose, a device 32*b* establishes a balance between the first and second resonances. The two resonances are still controlled (even with a zero volume), which makes it possible, on releasing the pedal, to still hear the sympathetic resonance of the free notes.

When the pedal is released, the sympathetic notes of the first resonance are played with a maximum volume and the sympathetic notes of the second resonance are played with a zero volume.

Conversely, when the pedal is completely depressed, the sympathetic notes of the second resonance are played with a maximum volume and the notes of the first resonance with a zero or virtually zero volume.

As a result of these characteristics the playing of an acoustic piano can be simulated with great realism. It is also possible to obtain sound effects not hitherto possible with synthetic instruments. It is in particular possible to obtain half-pedal effects, a sound with a weak constant half-pedal as in pianos at the start of the nineteenth century. It is also possible to obtain a pedal resonance e.g. with a clarinet tone quality.

We claim:

1. Process for the simulation of first sympathetic resonances for at least one electronic musical instrument adapted to generate sounds for a set of notes and to receive at least one of activation and release controls of at least one of excited and free notes, the activation controls causing the activation of the at least one of the excited and free notes and the release controls causing the release of the at least one of the excited and free notes, the process comprising:

updating, at least during each free note activation or release, at least one first list of free notes in which with each free note are associated harmonics of said free note;

updating, at least during each excited note activation or release, a second list of excited notes in which with each excited note are associated harmonics of said excited note;

for each free note activation, determining at least one harmonic of a note of the second list identical to each harmonic of said free note and differing from said free note, such that the playing of a sympathetic note is controlled at the pitch of each identical harmonic; and for each excited note activation, determining at least one harmonic of a free note of the first list identical to each harmonic of said excited note and differing from said excited note such that the playing of a base note at the pitch of a fundamental harmonic of said excited note and a sympathetic note are controlled at the pitch of each identical harmonic.

2. Process according to claim 1, wherein the playing of each base note and each sympathetic note with a volume evolving in time from an instant defined by the activation of said note is controlled in accordance with a predetermined envelope.

3. Process according to claim 2, wherein said envelope has a time decay in accordance with a user-modifiable, predetermined envelope dependent on a pitch of each base note and each sympathetic note.

4. Process according to claim 1, further comprising controlling the playing of each base note with a volume $V_b$ proportional to an excitation power of the corresponding excited note.

5. Process according to claim 4, further comprising controlling at the pitch of the sympathetic note the playing of each sympathetic note with a volume proportional to the volume $V_b$ of the excited note having a harmonic identical to theat of a free noted.

6. Process according to claim 1, further comprising controlling the playing of each sympathetic note with a volume proportional to a harmonic potential of the harmonic of the excited note corresponding to the pitch of the sympathetic note and proportional to a harmonic potential of the harmonic of at least one free string corresponding to the pitch of the sympathetic note.

7. Process according to claim 6, further comprising controlling the playing of each sympathetic note with a volume dependent on the time difference between the activation of the free note and the activation of the corresponding excited note is controlled.

8. Process according to claim 2, further comprising suspending the playing of a base note when its volume is below a predetermined value.

9. Process according to claim 2, further comprising suspending the playing of a sympathetic note when its volume is below a predetermined value.

10. Process according to claim 2, further comprising suspending the playing of a sympathetic note during a release control of all the free notes with which is associated the harmonic corresponding to the pitch of the sympathetic note.

11. Process according to claim 1, further comprising updating during each release control of an excited or free note, the first and second lists by withdrawing said free note from said lists.

12. Process according to claim 1, further comprising updating during the activation of both an excited and a free note, first the second list such that for each harmonic of the excited note is sought at least one identical harmonic of a free note of the first list for the activation of possible sympathetic notes, and only then updating the first list.

13. Process according to claim 1, further comprising performing pedal activation by simulation of a second sympathetic resonance in which are activated, as free notes, all the notes for which the instrument is able to generate sounds.

14. Process according to claim 13, wherein during simulation of the second sympathetic resonance, for each harmonic of each excited note seeking identical harmonics among the harmonics of all the notes for which the instrument is able to generate sounds, different from the excited note, and thereby controlling the playing of a sympathetic note with the pitch of each of said identical harmonics.

15. Process according to claim 14, wherein the sympathetic notes of the first resonance and the sympathetic notes of the second resonance are controlled with a volume weighted as a function of a pedal activation degree.

16. Process according to claim 1, wherein free note and excited note activation and release controls are supplied to a single instrumental interface.

17. Process according to claim 1, wherein free note and excited note release controls are respectively supplied to different instrumental interfaces.

18. Process according to claim 1, wherein a pedal activation is supplied by the operation of a pedal control interface.

19. Apparatus for sympathetic resonance simulation for an electronic musical instrument, the apparatus comprising:

at least one input adapted to receive activation and release control signals for at least one of excited and free notes;

a memory for storing a first list of free notes and a second list of excited notes;

means for associating with the listed notes harmonics corresponding thereto;

updating means adapted to add to the first list free notes activated during free note activation control and subtract from the first list free notes released during free note release control, and adapted to add to the second list excited notes activated during excited note activation control and subtract from the second list excited notes released during excited note release control;

means for seeking, for each harmonic of each free note activated during free note activation control, at least one identical harmonic of a different note in the second list and for seeking, for each harmonic of each excited note activated during excited note activation control, at least one identical harmonic of a different note of the first list; and a control signal generator for playing a base note corresponding to the pitch of a fundamental harmonic of each excited note and a sympathetic note corresponding to the pitch of each identical harmonic.

20. Apparatus according to claim 19, wherein the means for associating harmonics with the free and excited notes comprises a correspondence table between each note of a set of notes for which the electronic musical instrument is able to generate a sound and a set of harmonics associated with each of these notes.

21. Apparatus according to claim 19, wherein the means for associating harmonics with the free and excited notes comprises a harmonic calculation software.

22. Apparatus according to claim 19, further comprising means for updating a third list containing all the possible free notes of the instrument, the means for seeking adapted to seek during each activation of an excited note and for each harmonic of the excited note, at least one identical harmonic of a note different from the excited note in the third list for controlling corresponding sympathetic notes.

* * * * *